US007481158B2

(12) United States Patent
Gerngross et al.

(10) Patent No.: US 7,481,158 B2
(45) Date of Patent: Jan. 27, 2009

(54) APPARATUS AND METHOD FOR BALING LINT COTTON FIBERS

(75) Inventors: Royce H. Gerngross, Richmond Hill, GA (US); Joe W. Thomas, Richmond Hill, GA (US)

(73) Assignee: Lummus Corporation, Savannah, GA (US)

( * ) Notice: Subject to any disclaimer, the term of this patent is extended or adjusted under 35 U.S.C. 154(b) by 0 days.

(21) Appl. No.: 11/612,697

(22) Filed: Dec. 19, 2006

(65) Prior Publication Data

US 2008/0141873 A1 Jun. 19, 2008

(51) Int. Cl.
*B30B 15/30* (2006.01)
*B30B 13/00* (2006.01)

(52) U.S. Cl. ..... 100/45; 100/35; 100/50

(58) Field of Classification Search ..... 100/35, 100/45, 50

See application file for complete search history.

(56) References Cited

U.S. PATENT DOCUMENTS 4,006,679 A * 2/1977 Egosi ..... 100/138
5,110,517 A * 5/1992 Lukhard et al. ..... 264/40.1
5,325,770 A * 7/1994 Lukhard et al. ..... 100/3
5,687,643 A * 11/1997 Felts et al. ..... 100/3
5,868,067 A * 2/1999 Patton et al. ..... 100/50
2006/0143870 A1 * 7/2006 Irick et al. ..... 19/64.5

* cited by examiner

*Primary Examiner*—Jimmy T Nguyen
(74) *Attorney, Agent, or Firm*—Smith, Gambrell & Russell

(57) ABSTRACT

An apparatus and method for producing a bale of lint cotton fiber by pre-compressing each consecutive charge of fiber fed from the lint slide to a predetermined and uniform density. The apparatus includes a supply chamber predisposed with both vertical and horizontal platens driven by independent hydraulic cylinders. The movement and cycling of the platens is such that measured charges of fibers are presented to a vertical tramping device at consistent and uniform density. The tramping device, consisting of a platen driven by two hydraulic cylinders, packs each charge into a stationary box, one charge after another. This process continues until the desired bale weight is reached. The tramper cylinders are driven to a predetermined pressure setting during the tramping phase of each stroke cycle (extension) resulting in uniform compression (density). To maintain uniform density throughout the tramping phase of bale formation, the tramper stroke is varied by means of a closed loop control system and infinite position sensing.

7 Claims, 13 Drawing Sheets

APPARATUS AND METHOD FOR BALING LINT COTTON FIBERS

BACKGROUND OF THE INVENTION

This invention is an improved approach to baling and packaging of lint cotton in cotton ginning facilities hereinafter referred to as "cotton gins". For more than two hundred years the accepted method of packaging lint cotton for storage or transport at the cotton gin has been the bale. The "bale" is the preferred form of presentation used by the textile industry as a basis for blending fibers. At the cotton gin final packaging of lint cotton for shipment has historically been the function of the bale press. Many versions of bale presses producing various sizes and densities of cotton bales have been introduced to the ginning industry over the years. Today two preferred bale "types" dominate the global ginning industry. They are the Gin Universal Density and High Density bales.

Modern baling presses must meet design requirements to satisfy one or the other of the bale types. Domestically, that press is the Universal Density Baling Press; a press capable of producing a 500 lb. bale of lint cotton 55 inches in length by 20-21 inches in width and 26-30 inches thick. Such presses use hydraulics to drive the primary and secondary axes, to wit the main compression cylinder[s] and tramper cylinder respectively, although some presses currently in operation continue to use mechanical trampers.

The purpose of the tramper in the scheme of the modern baling press is to pack lint cotton from the lint slide into the press box. Press boxes on all Universal Density Presses are approximately equal in box opening size; width from side-to-side (54 inches+/−) and front-to-back (20 inches+/−). Box length, however, can vary depending on whether the press is up-packing or down-packing, whether boxes come with retaining dogs or without, the available press compressive tonnage capacity and manufacturer's preference. A significant number of modern conventional baling presses incorporate retaining dogs 30 (FIG. 3) into their press box designs. Retaining dogs have been a necessary evil due to the natural resiliency of compressed cotton lint. In cases where conventional press boxes are short relative to tramper compressive capability and/or tramper stroke length, retaining dogs are the critical component for keeping lint from springing out of the top of the press box. Retaining dogs are also intrusive. They conflict with the uniform flow of lint cotton during the tramping process. They present a mechanical challenge in that they must (depending on design) be removed from the internal regions of the press box during certain phases of the baling cycle. The presence of retaining dogs equates to additional cost and maintenance. For these reasons elimination of retaining dogs is gaining popularity in modern press designs albeit to the detriment of additional box length, deeper foundations for up packing presses (FIG. 1), higher roof lines for down packing presses (FIG. 2), and increases in hydraulic cylinder length, both that of the ram (primary axis) and tramper (secondary axis). The effect to date of eliminating retaining dogs has been to add to the cost of material in the manufacturing process, increase the cost of installation, plus additional pump and horsepower requirements in the application process.

Current gin baling presses incorporate basic PLC logic with discreet inputs and outputs as the control platform. While the industry has been well served by these control systems they are dated and fall short of meeting requirements for high speed operation with smooth accurate control. This invention advances the controls and hydraulics of the tramper and pusher to a new level of high speed operation all the while maintaining smooth accurate control. In order to accomplish this it is critical to have knowledge of the position of the tramper and pusher at all times. This allows for closed loop position based speed control. A closed loop position based control, unlike time based systems and/or fixed position systems used by current art, is not sensitive to the presence (or lack) of cotton. In order to achieve the type of control necessary accurate position feedback and high performance hydraulic valves are required.

One aspect of controlling the tramper and pusher axes is proportional hydraulic control technology. By combining proportional control technology with infinite position feedback this invention features a true closed loop control system. As a new feature for the cotton ginning industry, this invention includes proportional control valves with onboard electronics and spool position feedback for high performance. It also uses mango-restrictive linear transducer technology for accurate position feedback. One problem faced when using proportional valves on high speed machines is the cost associated with large valves, and the large valves inability to provide finite control at the low end of the flow range. The new technology on this press includes a high flow slave valve that is proportionally controlled by the flow rate through the master proportional valve. This slave valve is preset to open at a given flow rate and then continue to open proportionally to the increased flow through the main valve. This allows for the use of a small proportional valve in conjunction with one or more slave valves to accommodate very high flows during mid stroke. The relatively small proportional valve is then used as a standalone control for the low flow range.

One consequence of high-speed operation in current state of the art baling press technology is large inductive loads associated with oversized direct connected horsepower at the primary hydraulic movers. The motors are oversized in order to meet peak power needs, such as final bale compression, last few strokes of the tramper, etc.). The majority of the time these large motors are idling. Where pump motors are operating below full load, there is a loss in motor efficiency. It is not uncommon for hydraulic power unit designers to oversize motors and thereby build inefficiencies into the system. As a result of these "built in inefficiencies" gins pay higher demand and power factor charges. This invention uses a unique method to address these issues through an optimized horsepower control. With the availability of pressure feedback from both the tramper and press axes coupled with load sense pump controls and a proportional directional valve, the horsepower controller becomes a series of mathematical calculations within the press program. The end result of this unique control scheme is the ability to vary the power requirements of each axis as needed while at the same time optimize the available horsepower.

Another consequence of high-speed operation in current state of the art baling press technology is the difficulty associated with determining and maintaining a set bale weight. Feedback from force transducers, both electrical and hydraulic, have traditionally been used to approximate real-time bale density or weight. The short-comings of these devices are they are not accurate and are influenced by variables beyond the control of the system and/or operator, the least of which is variations in moisture content. This invention features position and pressure transducers that provide an accurate representation of real-time conditions throughout the formation of the bale. In addition, data tabulated from the transducer feedback along with bale density history and moisture content data provide this invention with the ability, through a series of algorithms, to anticipate true bale weight and meter the final charges of cotton by varying run time and speed of a lint feeding device 4.

This invention is a short box press utilizing a hydraulically driven actuator to pre-compress approximately 500 pounds of ginned lint cotton in such a manner no additional mechanical retaining-devices are required to hold the lint in the short box. It is the object of this invention to overcome the short-comings associated with long press boxes and/or short press boxes requiring lint retaining devices. A further object of this invention is to introduce feedback from various analog inputs to 1) control acceleration and deceleration of the hydraulic axes at their respective limits, to 2) determine both actual bale weight and bale moisture content via an industrial programmable computer (PC) program utilizing input data from various field devices and pre-configured algorithms, and 3) through load sensing, reduce direct connected horsepower requirements to an optimum.

BRIEF DESCRIPTION OF THE DRAWINGS

Apparatus embodying features of the prior art and the current invention are depicted in the accompanying drawings which form a portion of this disclosure and wherein.

DETAILED DESCRIPTION

Figure 1:
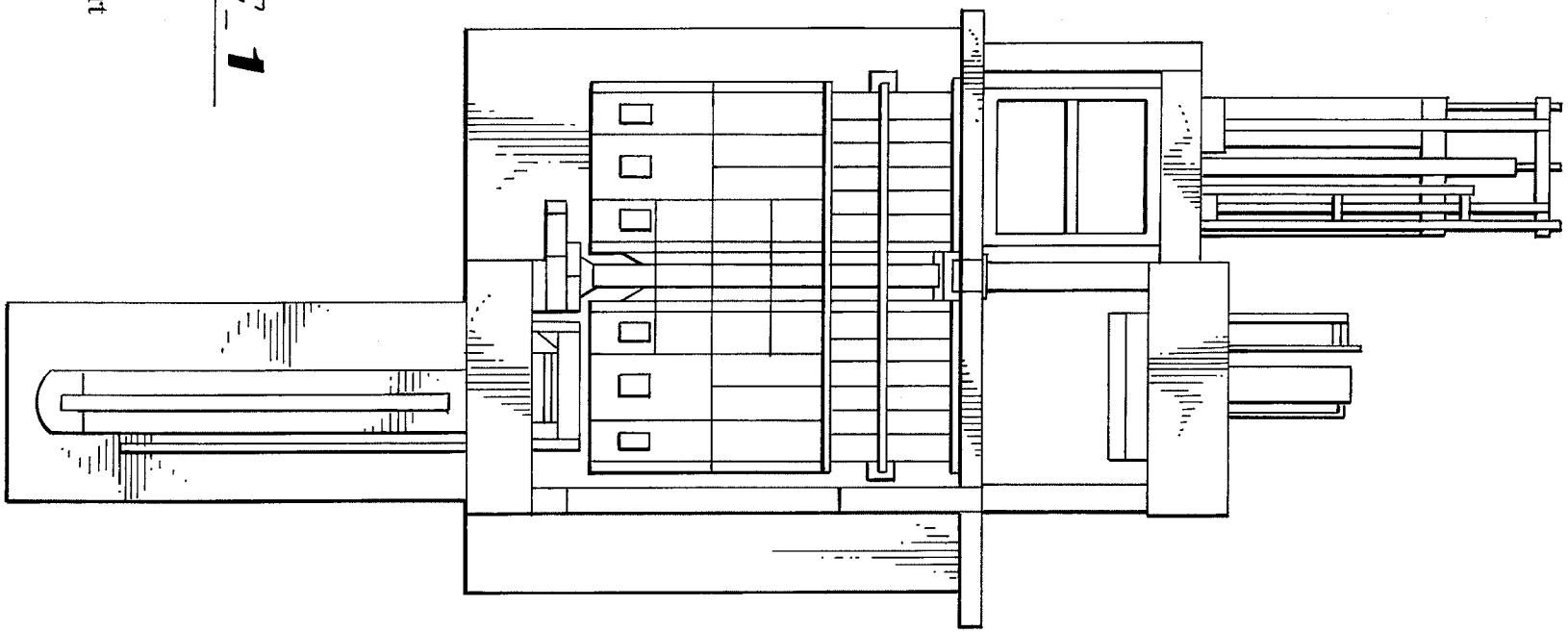
Fig. 1 Prior Art
FIG. 1 is an elevation view of a prior art up packing baler.
Figure 2:
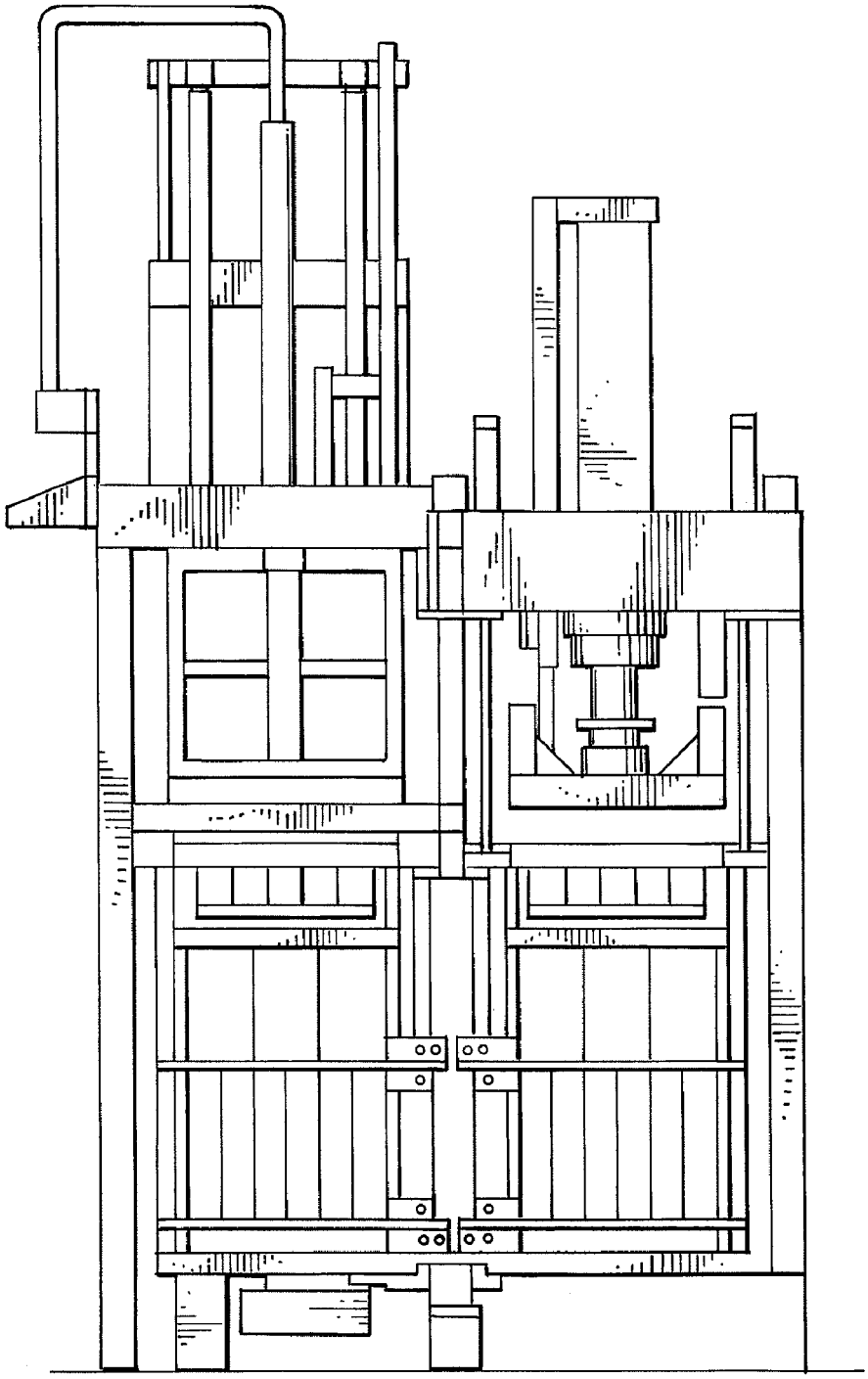
Prior Art Fig. 2
FIG. 2 is an elevation view of a prior art down packing baler.
Figure 3:
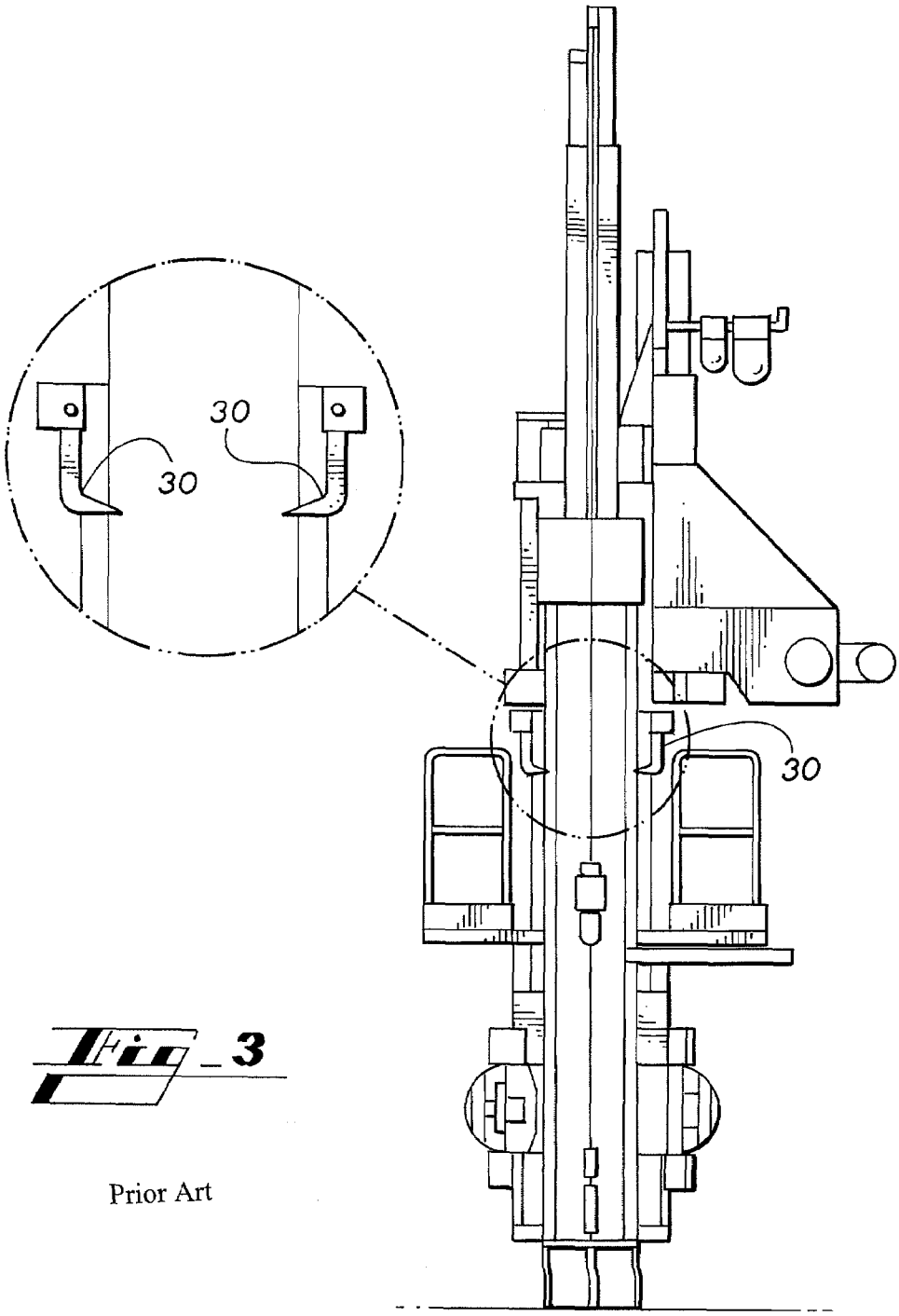
Fig 3 Prior Art
FIG. 3 is a side elevation view showing the dogs of a prior art press box in a prior art baler.
Figure 4:
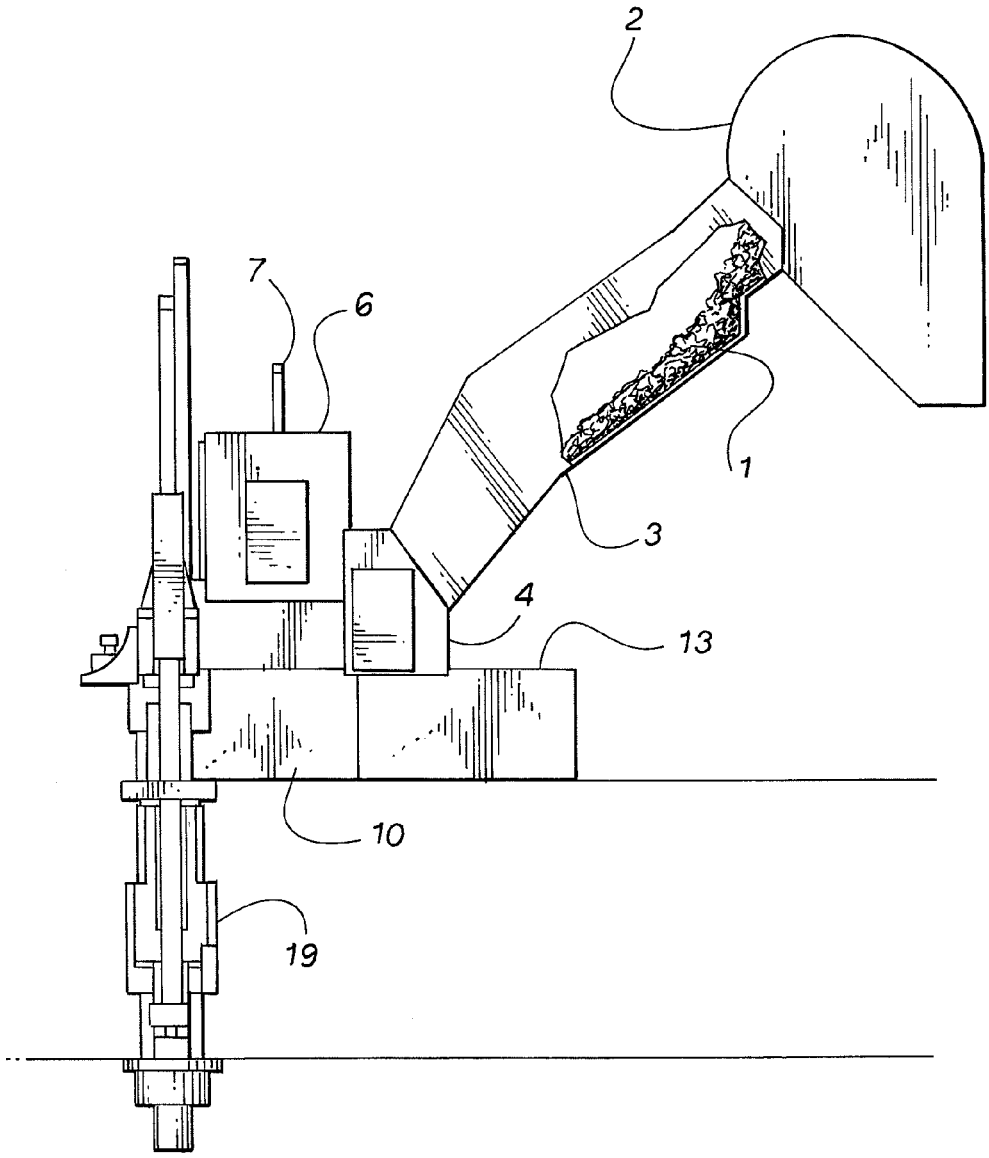
FIG. 4 is a side elevation view of the condenser, lint slide, pre-pack and tramper of one embodiment of the invention.
Figure 7:
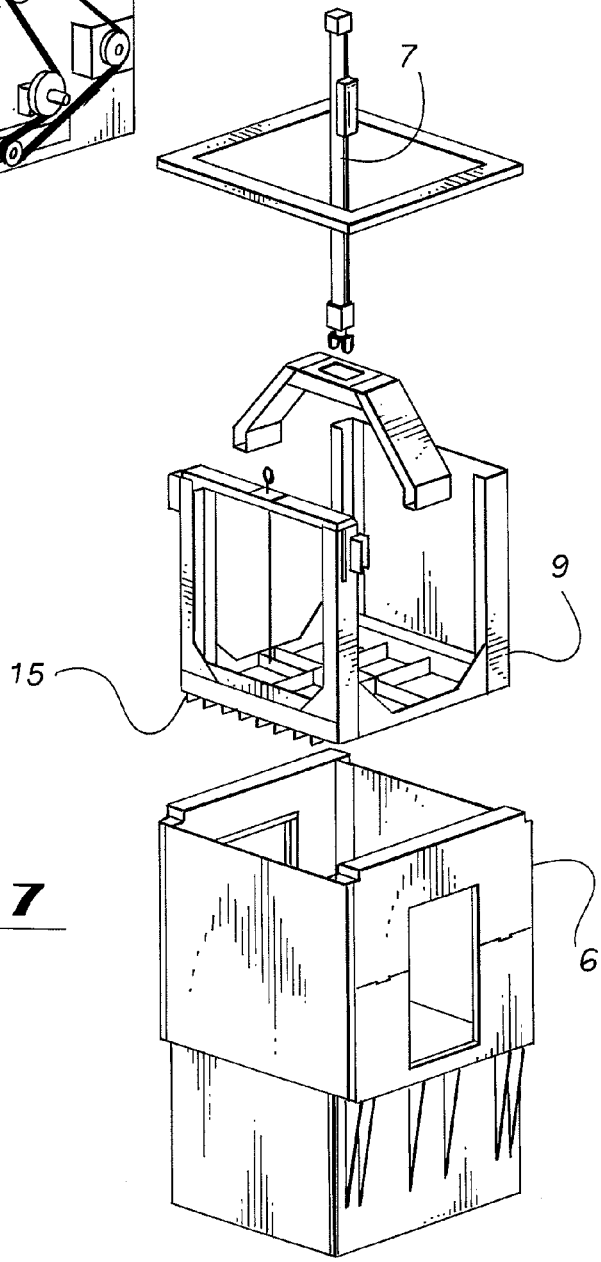
FIG. 7 is an exploded perspective view of the pre pak vertical cylinder and compression foot.
Figure 8:
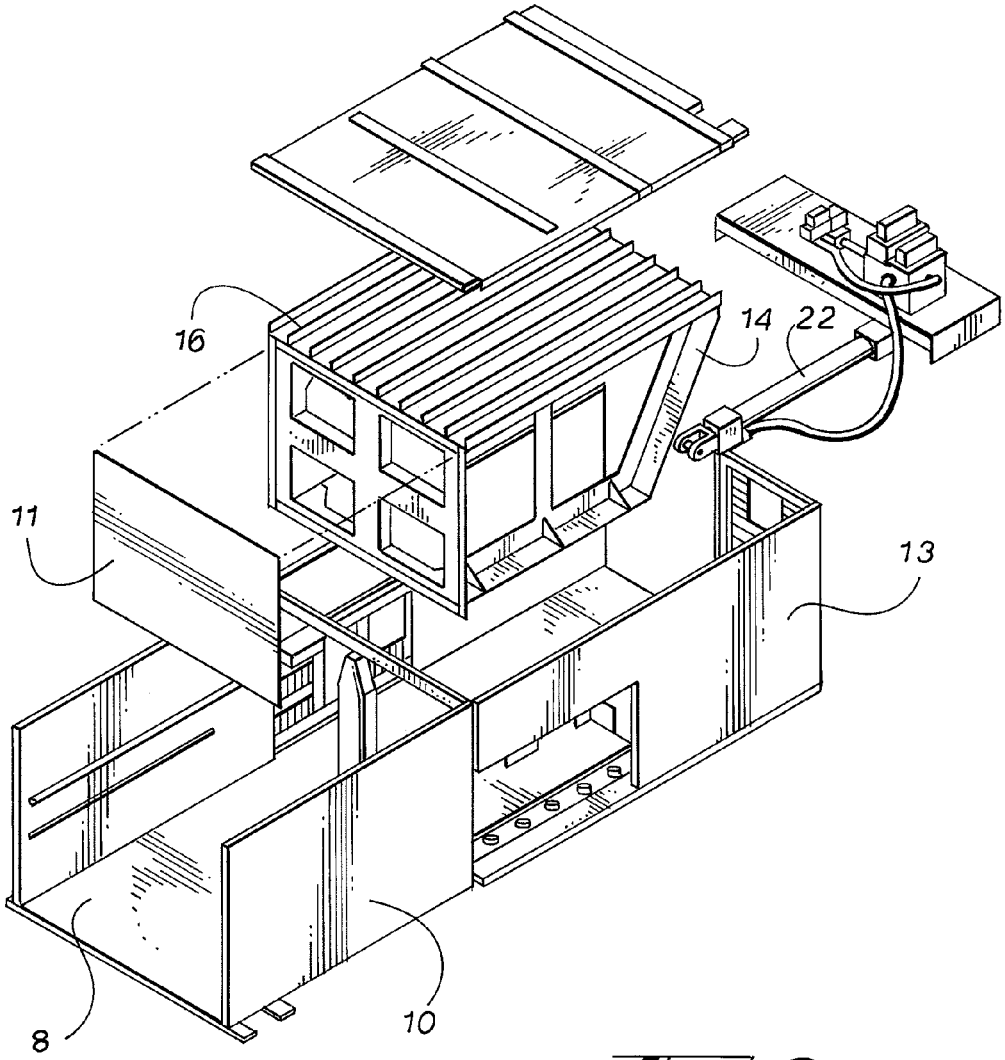
FIG. 8 is an exploded perspective view of the pre pack pusher and charging box.
Figure 11:
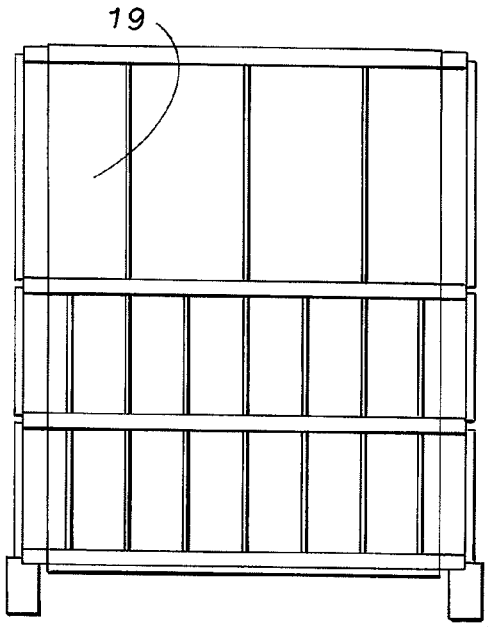
FIG. 11 is an elevation view of the press box

Referring to FIG. 4, lint cotton 1 from a lint condensing apparatus 2 is continuously fed into an inclined slide 3 which in turn introduces the lint cotton in bat form to the lint feeder 4. The lint feeder control feeds the lint cotton by means of two variable speed opposing feed rollers 5 shown in FIG. 6, into the baler receiving and charging apparatus P, hereafter referred to as the Pre-pak. The metering of the lint cotton 1 into the Pre-pak is achieved through a combination of variable frequency controlled drive, programmable timer logic and a process system production rate algorithm. Calculations for the output signal to the lint feeder 4 are processed by an industrial PC. The optimum amount of lint cotton 1 per charge to be fed to the Pre-pak is 100 pounds or 44 kilograms although lesser amounts can also be accommodated. Once charged fully, the lint feeder rollers 5 will stop running and the Pre-pak vertical charging cylinder 7 extends downward pre-compressing the charge of lint cotton 1 into a chamber in the lint pusher 13. At this point in the process the Pre-pak compression foot 9 serves as the upper most component of the pusher chamber 10. As seen in FIG. 7 and 8, the lint is compressed between the pusher chamber floor 8 and the Pre-pak compression foot 9. The extend stroke as well as the retract stroke of the Pre-pak is controlled through a closed loop PID control to advance rapidly with a smooth stop regardless of the back pressure applied by the cotton.

Lint cotton by nature is very cohesive while at the same time extremely resilient. This combination of properties results in a material that resists confinement (thus tends to expand against the direction of compression, and to a lesser degree, perpendicular to the direction of compression). One adverse effect is the formation of wads in areas of opportunity such as in seams and gaps. Such an area of opportunity is the juncture between the fully extended Pre-pak compression foot 9 shown in FIG. 7 and the face of the pusher 11 shown in FIG. 8. In order to assure continuous production, wads must either be removed or sheared through by a mechanical means. As removal of the wads is not an option, opposing mechanical devices have been employed on the Pre-pak compression foot 9 as and top surface of the pusher carriage 14 as a means to shear through the wads. In both cases the mechanical device is a vertical fin running the length of the surface from front to back. As shown in FIG. 5A, the fins 15 on the Pre-pak compression foot are equidistance apart as are the fins 16 on the pusher carriage surface but located in such a way the opposing fins are midway between each other. The relative location of the respective fins 15 and 16 and the mechanical action of the moving pusher carriage 14 opposed to the stationary Pre-pak foot 9 creates the "shearing" action required to clear the wad(s).

Once lint cotton has been compressed by the Pre pak 6 and the Pre-pak compression foot 9 is fully down, the pusher carriage 14 is given the signal by the industrial programmable computer to extend. The pusher cylinder 22 will extend fully, forcing the charge of lint cotton into the tramper charging hopper 23 shown in FIG. 5, further pre-compressing the lint. The extend and retract strokes of the pusher carriage 14 are controlled using the same closed loop position based PID to accomplish rapid smooth motion regardless of the amount of cotton in the pusher. With the pusher cylinder 22 fully extended and the pusher carriage 14 in the fully extended position, the tramper cylinders 20 are given the signal by the industrial PC to extend. The tramper foot 12 and lint shield 17 extend downward, further pre-compressing the charge of lint cotton. When the tramper foot 12 has traveled downward to the point where the bottom of the foot is even with the bottom of the pusher chamber 8, the pusher cylinder 22 is given the signal by the PC to retract. Once retracted the lint pusher 13 is ready to receive the next charge of lint cotton from the lint feeder 4 and Pre-pak 6.

Figure 5:
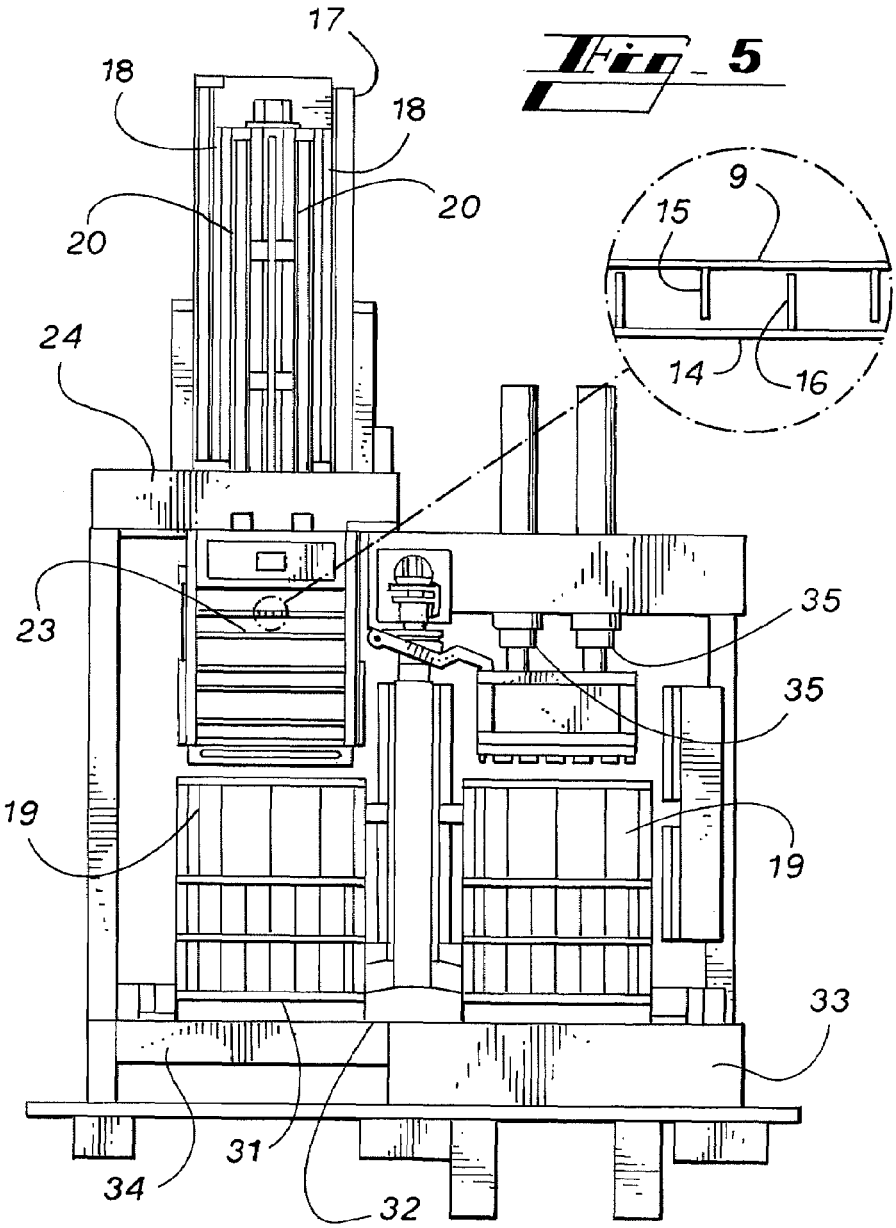
FIG. 5 is a front elevation view of the tramper station and the baling station.
Figure 9:
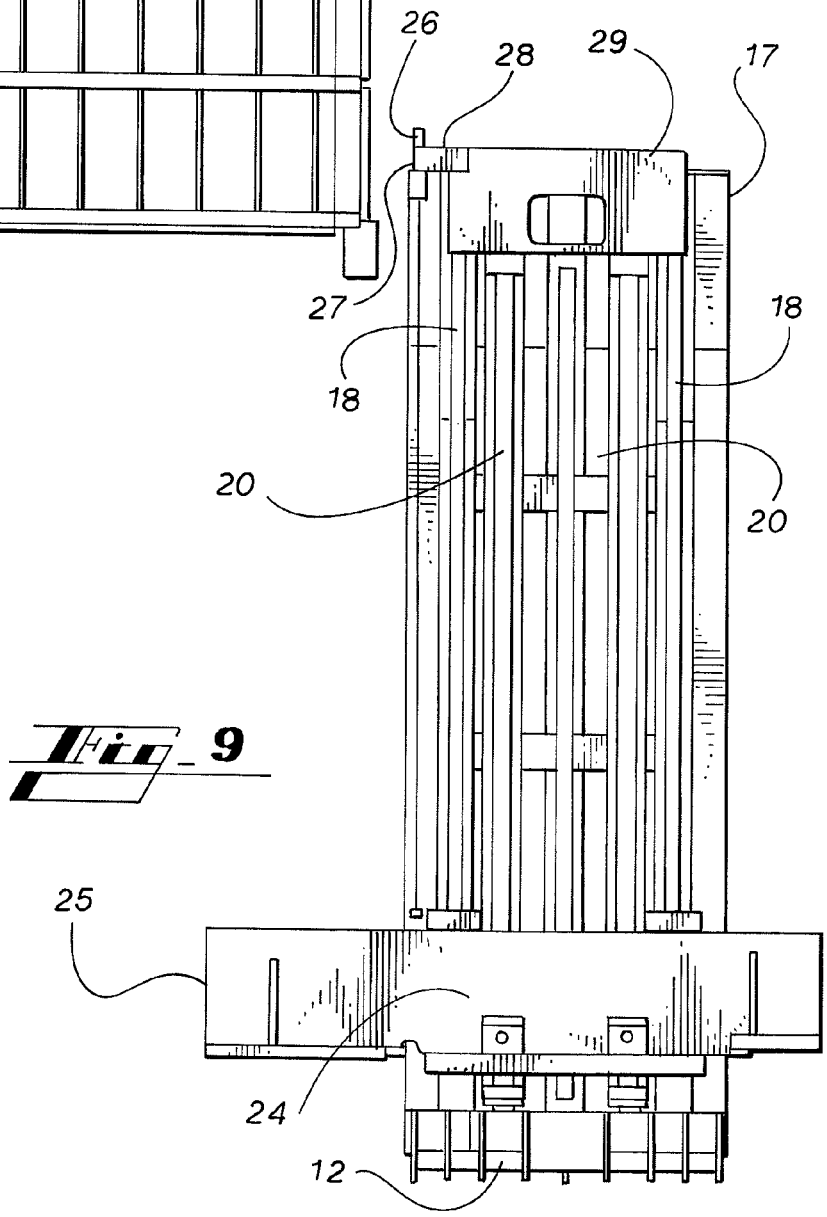
FIG. 9 is an elevation view of the tramper.
Figure 10:
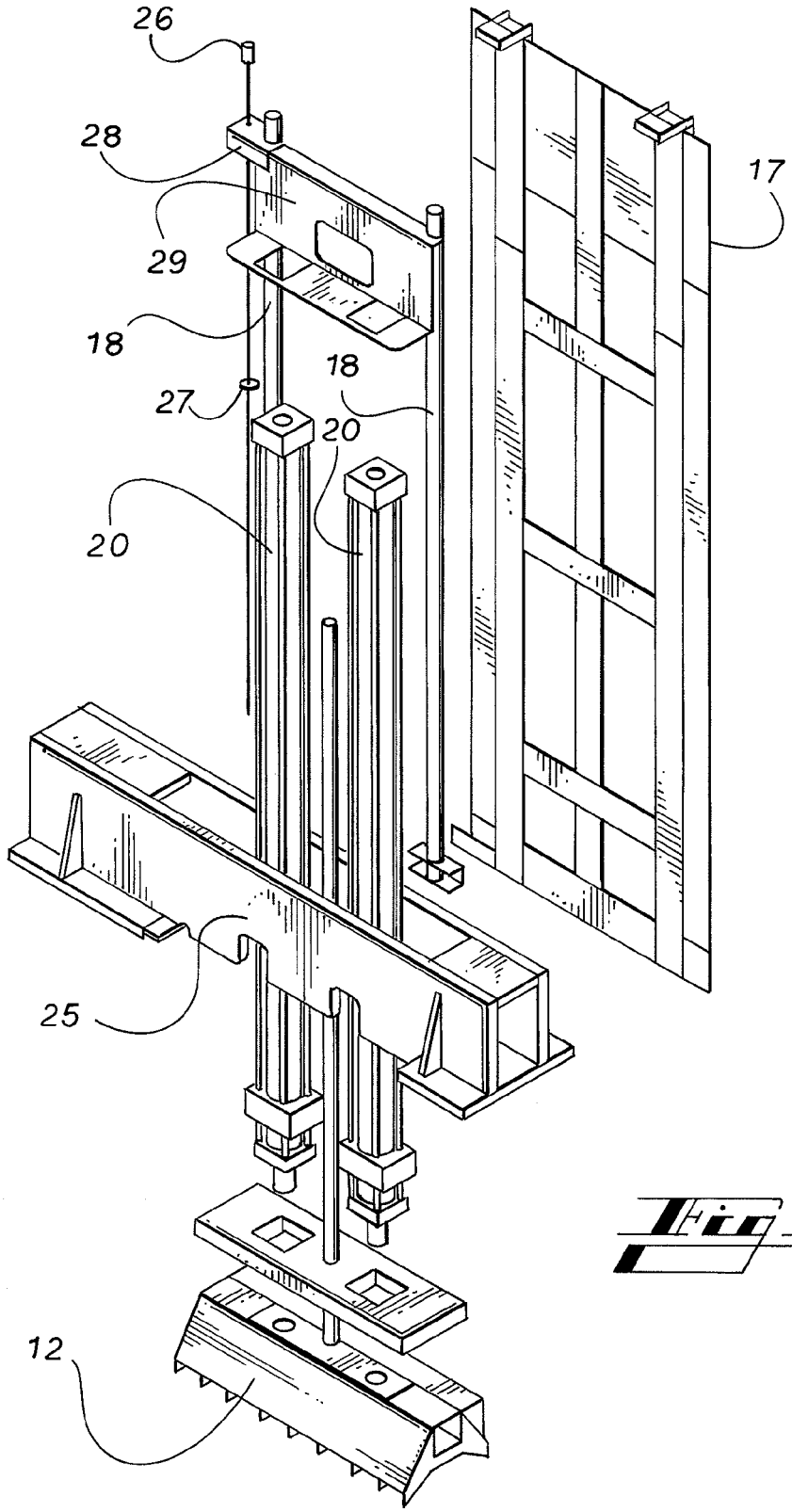
FIG. 10 is an exploded perspective view of the tramper.

The new tramper 24,shown in FIGS. 5 and 9, uses of two hydraulic cylinders mounted vertically and offset to one side of the baler to where the tramper 24 is centered over one or the other of the baler boxes 19 (depending on the hand of the baler). Mounted to the tramper cylinders 20, see also FIG. 10, are the tramper foot 12, lint shield 17 and the lint shield supports 18. The tramper cylinders 20 are mounted to the tramper sill 25. At the top of the tramper cylinders 20 is mounted the position transducer 26. A switch bracket 28 containing a magnet 27 is mounted via mount frame 29 to the lint shield supports 18 which are attached to the tramper foot 12. The position transducer 26 provides continuous input to the PC and infinite feedback as to the tramper foot position. The hydraulic tramper cylinders 20 are of a special design requiring no external guidance and are of a special designed stroke length. The stroke length is special in that this tramper 24 is capable of variable stroke depending on the distance the tramper foot must travel downward into the baler box 19 to produce a pre-determined amount of force. The premise behind the design is to maintain a constant force component while varying the distance between all down at a given platen-to-tramper foot separation and final down at a variable platen-to-tramper foot separation. The final separation is a variable as it is a function of moisture content, lint cotton density and compressive force. This action of pre-compressing at constant force counters the impact of the natural resilient tendency of the fibers enough to eliminate the necessity for mechanical retaining dogs, even in a short box 19.

Figure 12:
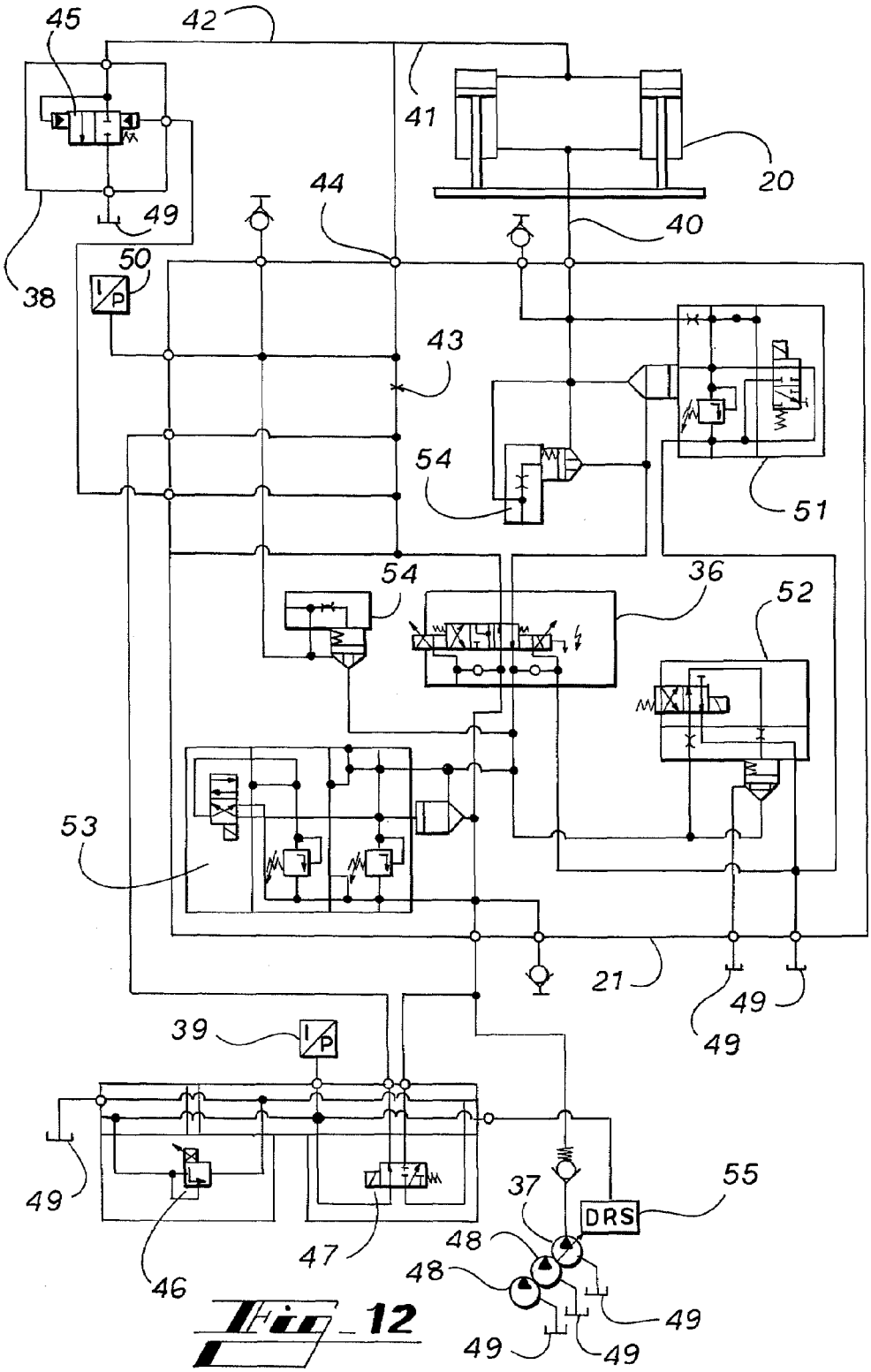
FIG. 12 is a schematic view of the tramper hydraulic circuit with the tramper extending in a regeneration mode.

The extend stroke of the tramper uses a combination of infinite position feedback along with infinite pressure feedback at the pump to control the speed of the tramper foot 12. Referring to FIG. 12, while in extend the load sense control 55 on the pump is utilized to maintain a predetermined pressure drop across the proportional valve 36. This action in turn limits the volumetric output of the pump 37 thus controlling the consumed horsepower of the pump. Depending on the load under the foot 12 of the tramper 24 the extend speed will either be controlled by horsepower or actual position. When no load is present the speed is decelerated by a position based algorithm. However if a load is sensed and horsepower limitations slow it down naturally, the deceleration algorithm is by-passed. In order to retract under smooth rapid conditions the position based algorithms and infinite position feedback are used to accelerate and decelerate in a continuous smooth motion.

FIG. 12 shows schematically the extend stroke of the tramper cylinders 20 in regeneration. The initial movement of the extension stroke is smoothly controlled by a throttling algorithm in the PC program that provides a controlled signal to the proportional valve 36. The algorithm throttles the valve to full open for maximum flow. This first phase of the extension stroke incorporates a regeneration of the hydraulic fluid from the rod end conduit 40 thereby increasing the effective rod speed without the need for additional pumps. During regeneration hydraulic fluid from the rod end conduit 40 is redirected to the blind end conduit 41 by way of counter balance valve 51 and proportional valve 36. The regeneration circuit is completed by activation of regen valve 52 which blocks the rod end hydraulic fluid from returning to tank 49. The rod end hydraulic fluid passes through the open pilot operated check valve 54 thus adding flow to the hydraulic fluid from pumps 37 and 48. During this phase of the cycle the proportional valve 36, deceleration valve 46, load sense valve 47, counter balance valve 51, regen valve 52 and devent valve 53 are active. The variable displacement pump 37 is controlled by load sense valve 47, the fixed displacement pumps 48 follow a load algorithm in the PC program and the DAU 38 is passive.

Figure 13:
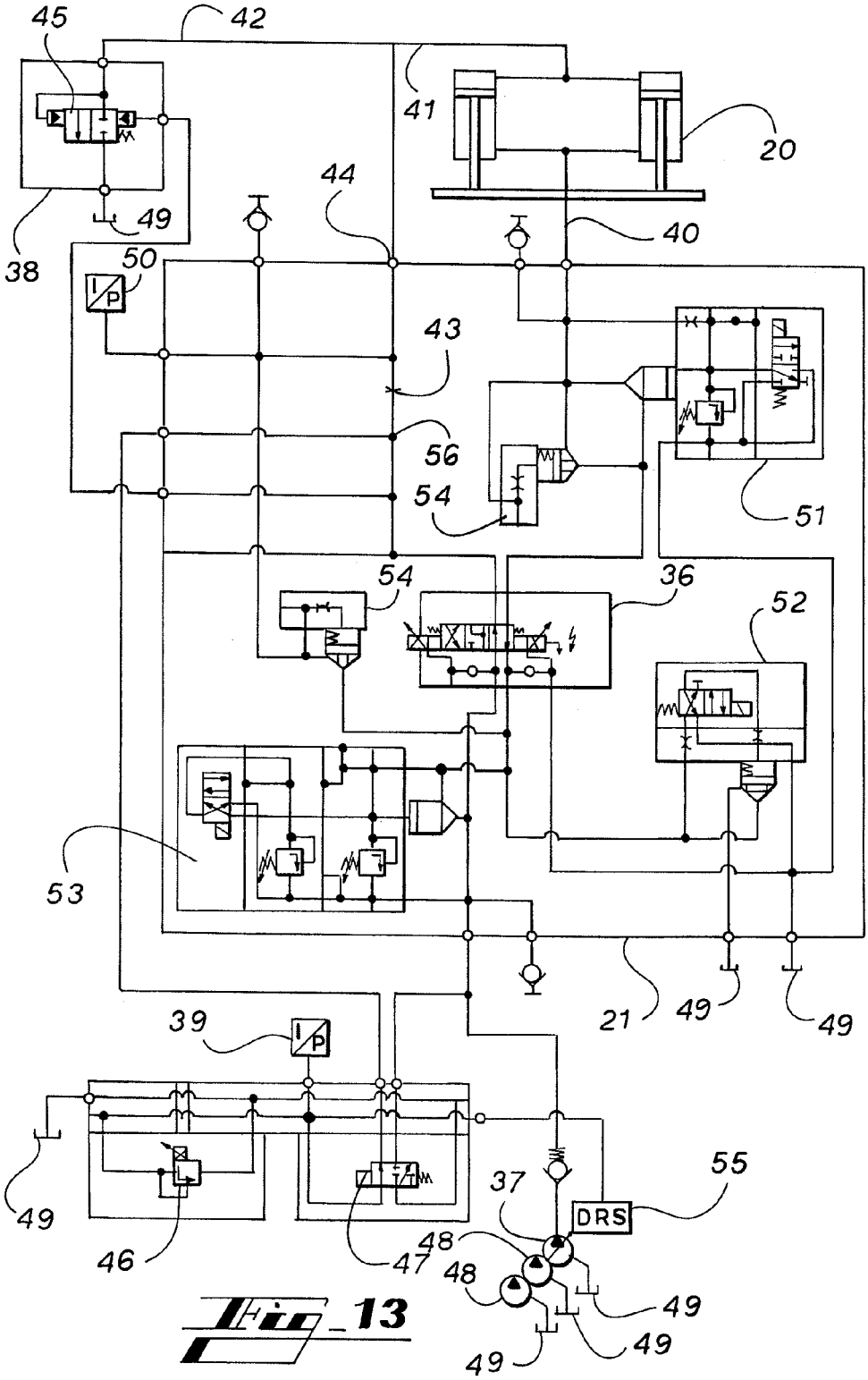
FIG. 13 is a schematic view of the tramper hydraulic circuit with tramper extending in a non-regeneration mode; and, FIG. 14 is a schematic view of the tramper hydraulic circuit with the tramper retracting.

FIG. 13 shows schematically the extend stroke of the tramper cylinders 20 out of regen. All devices remain active as shown in FIG. 12 with the exception of the counter balance valve 51 and the regen valve 52. Load sense 55 continues to control the variable displacement pump 37 and the PC algorithm controls fixed displacement pumps 48. In this phase of the cycle the pilot operated check valve 54 is closed by hydraulic pressure while regen valve 52 opens to allow the rod end oil from rod end conduit 40 to flow to tank 49. During the extend stroke a load algorithm in the PC program will have dropped out the fixed displacement pumps 48 based on motor load utilizing input from pressure transducer 39. The variable displacement pump 37 will continue to follow load sense 55 until the cylinders 20 have reached the extension limit. At the end of the extend stroke the proportional valve 36 is throttled closed using an algorithm in the PC program. During the final deceleration the deceleration valve 46 is passive as are the counterbalance valve 51 and the regen valve 52. The point at which deceleration starts and that of full stop at the end of the extension stroke are determined by feedback from position transducer 26 or pressure transducer 50. Position is primary unless overridden by pressure should pressure exceed the limit set by the PC.

Figure 14:
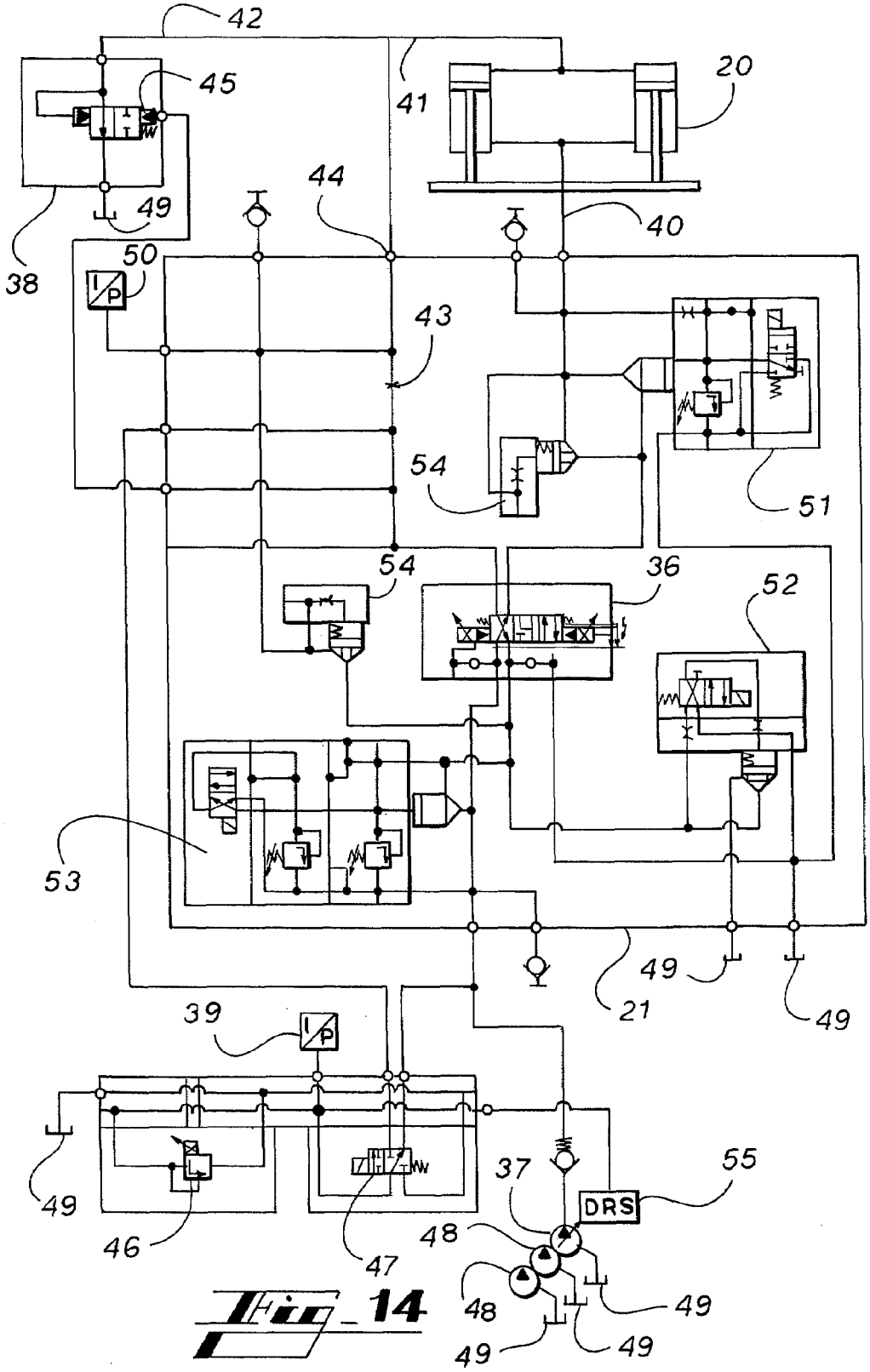

Returning to FIG. 5 it is apparent the tramper 24 is predisposed to displace an abundance of hydraulic fluid via conduits strategically located between the tramper cylinders 20 and an integral power unit schematically depicted by FIG. 12. In FIG. 12 both the rod end conduit 40 and blind end conduit 41 from the tramper cylinders 20 terminate at a hydraulic control manifold 21. A blind end by-pass conduit 42 is teed to conduit 41 in order to by-pass high volumes of oil around hydraulic control manifold 21 via a control system for a hydraulic load as patented in U.S. Pat. No. 4,429,619, which is incorporated by reference, hereinafter referred to as the DAU 38. As depicted in FIG. 14 the DAU 38 is effective only in the return (up) stroke of the tramper cylinders 20. This is due to the limited ability of the proportional valve 36 to flow a high volume of hydraulic fluid from the blind end conduit 41 during the return stroke cycle of the tramper cylinders 20. It should be noted that use of the DAU is totally dependent on volume of oil flow. As a result multiple DAU may be required regardless of stroke direction. At the initial movement of the up-stroke, proportional valve 36 and deceleration valve 46 are throttled open based on algorithms programmed in the PC. Load sense valve 47, counter balance valve 51 and regen valve 52 are passive. Due to low back pressure across fixed orifice 43 the DAU 38 is closed. The variable displacement pump 37 is controlled by deceleration valve 46 and the fixed displacement pumps 48 are off-line. The devent valve 53 is active. After the initial start to retract, the tramper cylinders 20 go to full speed. The proportional valve 36 is active along with the deceleration valve 46, and the fixed displacement pumps 48 are full on-line. The hydraulic fluid entering the manifold 21 creates a pressure drop across the fixed orifice 43 located strategically in-line between the proportional valve 36 and the blind end conduit connection point 44. The pressure differential is sensed at either end of the DAU spool 45 causing the spool to shift at a predetermined pressure drop level as depicted in schematic FIG. 14. The DAU 38 continues to by-pass the hydraulic fluid around the hydraulic manifold 21 as long as the pressure drop across fixed orifice 43 is maintained. The amount of fluid allowed through the DAU varies proportionally to the amount of fluid that is allowed to pass through the proportional valve 36. As a result the DAU 38 opens and closes proportionally to the main proportional valve 36 with a DAU crack open level predetermined by the size of spring in the DAU 38. This condition would continue un-checked were it not for the unique position feedback from position transducer 26 and the pressure limiting deceleration valve 46. As the tramper cylinders 20 approach the retract limit of their stroke, as indicated by feedback from position transducer 26, fixed displacement pumps 48 attached to the main driver are vented to tank leaving only the variable displacement pump 37 to retract the tramper cylinders 20. The hydraulic fluid output of the variable displacement pump 37 is throttled back according to an algorithm in the PC program and the action of the pressure limiting deceleration valve 46. At some point in the deceleration the volume of fluid goes below the DAU crack open level and the motion of the cylinders is fully controlled by proportional valve 36. This condition at the limit of the tramper cylinder 20 retract stroke provides for a smooth controlled stop. During the deceleration phase of the retract load sense valve 47, counter balance valve 51 and regen valve 52 are passive. The devent valve 53 is active.

The aforementioned sequence of operation is repeated until either the tramper foot 12 extends to a predetermined distance from the bottom follow block 31 (FIG. 5) or the operator intercedes by manually cycling the press. In either case the indication is the quantity of lint cotton in the box 19 under the tramper 24 is sufficient to make a bale. At this point the tramper foot 12 retracts to a position just above the top of the box 19 and stops. The press bed 32, shown in FIG. 5, holding both boxes 19 will then lift approximately 1-½ inches to clear the bottom sill plates 33 and tramper end bed support 34, and rotate 180 degrees placing the just charged box under the main compression rams 35 and an empty box under the tramper 24. This same sequence for an up-packing press does not involve the lifting of the bed. However, the press boxes turn in a similar manner as those on a down-packing press once the signal to start the turning cycle has been initiated. Final compression of the bale by the main compression rams 35 followed by strapping of the bale will take place simultaneously with the charging of new lint cotton as described from the beginning of this detailed description.

It is known that bale compression force can be predicted using an algorithm, $\log 10F=2.0929-0.0313m+2.4469 \log 10p$, developed through research conducted by the USDA-ARS. The algorithm contains three unknown values; compressive force (F), percent moisture in lint-wet basis (m) and bale density (ρ) in pounds per cubic foot or kilograms per cubic meter. This invention incorporates technology capable of solving for two of the three unknown values, F and ρ, thus leaving one equation with one unknown for a final solution. By means of an algorithm in the PC program and input from pressure transducer 50, compressive force (F) is calculated. A pre-programmed density algorithm, including a customized value for press box 19 cross-sectional area and foot 12 separation distance as determined by input from position transducer 26, calculates bale density (ρ) once actual bale weight data is inputted to the PC, either manually or via communication protocol from an electronic bale scale. The two known values, F and ρ, are then applied to a derivation of the Force prediction algorithm to arrive at an average percent moisture (m) value which is than stored in a data array along with corresponding bale weight values. After validation the moisture values are calibrated by means of slope and off-set functions within the PC program. The accumulated bale moisture data is available as a means to trim the bale weight adjustment function as well as a moisture management tool for the operator.

Bale weight determination is a function of lint cotton throughput, the final position of the tramper foot 12 relative to the top of the lower follow block surface 31 as determined by input from position transducer 26 and the amount of force required for the tramper foot 12 to reach the point of final position as determined by input from pressure transducer 50. Prior to pre-compressing lint cotton under the tramper foot 12 inputs from the operator have established a maximum pressure setting and an arbitrary final bale position setting. As incremental charges of lint cotton are compressed by the action of the tramper cylinders 20 and tramper foot 12 the tramper 24 extends to a maximum stroke position until the resistance of the compressed lint cotton in the press box 19 results in the pressure on the blind end conduit 41, as measured by pressure transducer 50, exceeding the pre-determined pressure setting. From this point forward the tramper 24 extension stroke is controlled by pressure as each succeeding stroke will go to the maximum pressure preset. As lint cotton continues to be charged into the press box 19 the cumulative effect is for the tramper foot 12 to extend less further into the press box 19. When the extension of the tramper foot 12 reaches a predetermined window of distance from the pre-set final bale position setting, all as determined by input to the PC from position transducer 26, an algorithm in the PC program takes control of the lint feeder 4 variable frequency drive control varying the run time of the feed rollers 5 thus metering the amount of final lint cotton into the Pre-pak and lint pusher 13. The net effect is an acceptable approximation of a final bale weight. In manual mode the operator makes adjustments to both the final bale position and maximum pressure settings via a graphic operator interface communicating directly with the industrial PC. In automatic mode the final bale position remains a manual setting but the pressure setting and run time for the lint feeder rollers 5 are determined by an offset from accumulated bale weight data. The program in the industrial PC automatically makes incremental adjustments to maximum pressure and run time based on the amount of offset. The offset can be further trimmed by a correction factor provided by bale moisture content data.

The Horsepower control of the entire machine utilizes pressure feedback from both the tramper 24 and the main compression rams 35 as shown in FIG. 5. Pressure sensors in the circuit for the main compression rams provide the feedback in a known manner. With the horsepower consumption on both the tramper and main ram controlled via the industrial PC and load sense circuit, this invention is capable of allocating more or less horsepower on the extend cycle of each axis depending on the consumption level of the other axis. The net result is an optimization of the size of the motor on the machine bringing the nameplate horsepower of the motor much closer to the RMS (root mean square) horsepower of the machine.

Figure 6:
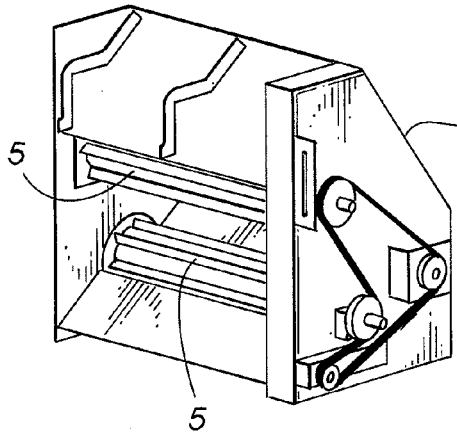
FIG. 6 is a perspective view of the pre pack feeder rollers.
Figure 15:
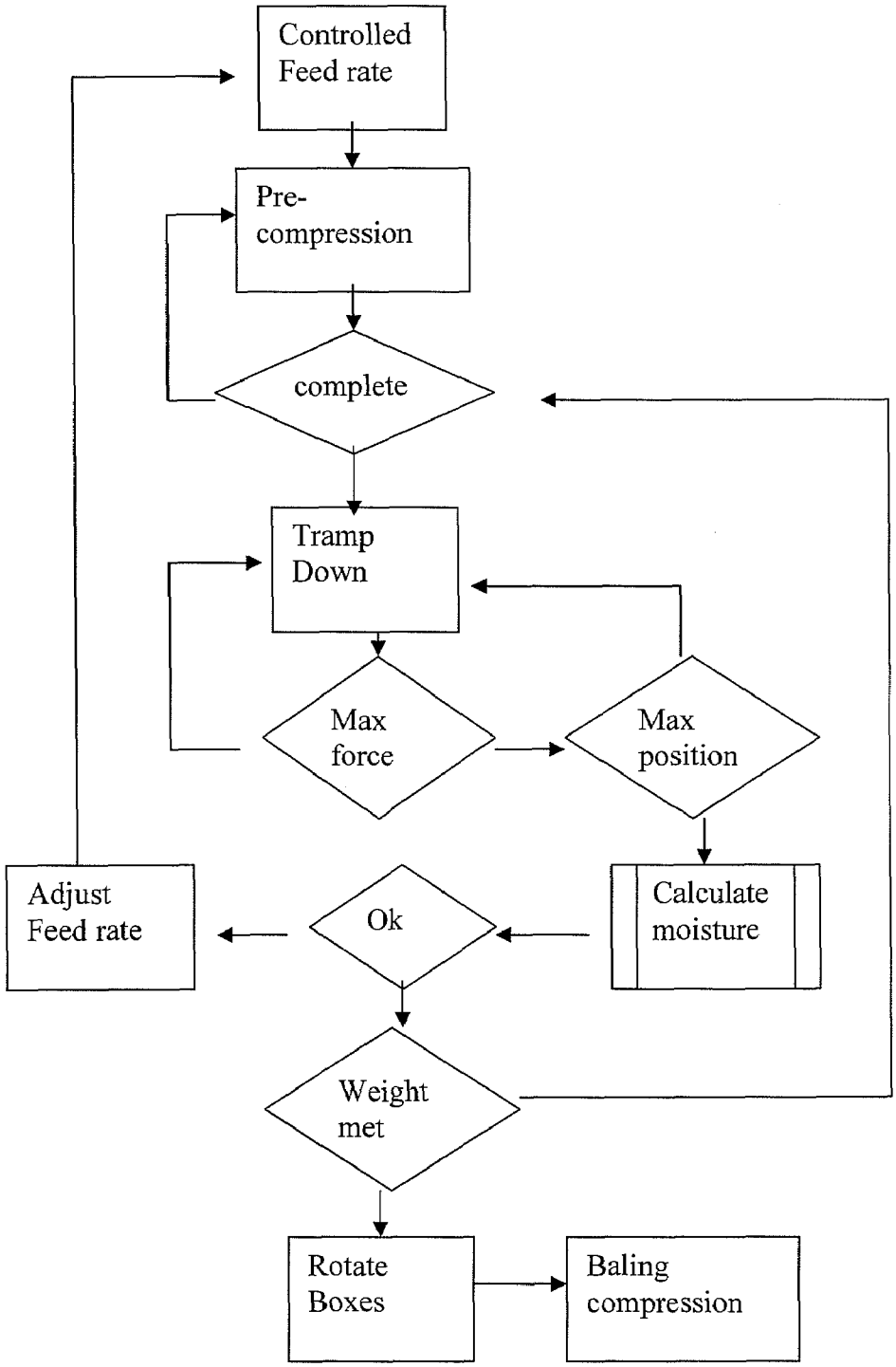
FIG. 15 is a flow chart of the method of baling.

FIG. 15 provides a flow chart of the above described method for controlling the baling mechanism and illustrates the steps of:

controlling the feed rate of unbaled fibrous material into the pre-compression supply station using variable speed opposing feed rollers 5 shown in FIG. 6 to form discrete charges of material having substantially uniform weight and density, wherein iteratively urging said charges of material which have been pre-compressed along a first axis by compression foot 9 which maintains compression on the charge of fibrous material while using pusher cylinder 22 urges the charge along an orthogonal axis from said pre-compression chamber into said tramping mechanism thereby shearing excess fibrous material extending beyond said compression chamber as herein above described and shown in the figures, thereby further pre-compressing the lint.

compressing each charge within a baler box of known dimensions with said tramping mechanism to a uniform density by moving a tramping foot as shown in FIG. 10 in one dimension into and within said baler box, sensing the position of said tramping foot with position transducer 26 and the force as indicated by transducer 50 required to urge said tramping foot to a variable position within said baler box for each charge of material based on a predetermined level of force, as described herein above, dynamically determining the moisture content of said fibrous material based on an assumed density and force relationship, and the force and position sensed; and, varying the rate of feed of said fibrous material in accordance with said dynamically determined moisture content relative to a predetermined moisture content;

In the above method, the movement of said tramping foot is varied to achieve substantially universal density in a bale formed from a plurality of charges of material within said baler box. Further, as described above the method contemplates varying the rate of feed of said fibrous material based on said dynamically determined moisture content to achieve substantially the same weight in successive bales of fibrous material formed from said charges. In the foregoing manner, the method provides for moving a baler box 19 containing a desired quantity of fibrous material to a baling station as shown in FIG. 5 concomitantly with moving a second baler box into position to receive charges of fibrous material such that the method will allow compressing the fibrous material in the filled baler box to a final bale compression in said baling station while tramping subsequent charges of fibrous material into said second baler box as described above. As hereinabove described the method also includes dynamically monitoring the pressure utilized by the tramping mechanism and the baling station via the industrial PC and load sense circuit to allocate horsepower to meet the needs of each.

While the present invention has been discussed in a single embodiment, the scope of the invention is not so limited but rather is defined by the full breadth of the appended claims.

What is claimed is:

1. A method for controlling an apparatus for baling fibrous materials to control the weight of bales produced by said apparatus, comprising the steps of:

a) controlling a feed rate of unbaled fibrous material into a pre-compression supply station to form discrete charges of material having substantially uniform weight and density, b) iteratively urging said pre-compressed charges of material into a tramping mechanism, c) compressing each of said charges of material within a baler box of known dimensions by applying a force with said tramping mechanism to a uniform density by linearly moving a tramping foot to a variable position into and within said baler box, d) sensing positions of said tramping foot during operation of the apparatus and sensing the force required to urge said tramping foot to a variable position within said baler box for each of said charges of material based on a predetermined level of force, e) dynamically determining a moisture content of said fibrous material based on an assumed density and force relationship, and the force and position sensed; and, f) varying the rate of feed of said fibrous material in accordance with said dynamically determined moisture content relative to a predetermined moisture content.

2. The method as defined in claim 1 further comprising varying the movement of said tramping foot to achieve substantially universal density in a bale formed from a plurality of charges of material within said baler box.

3. The method as described in claim 1 further comprising varying the rate of feed of said fibrous material based on said dynamically determined moisture content to achieve substantially the same weight in successive bales of fibrous material formed from said charges.

4. The method as defined in claim 1 further comprising, a. moving said baler box containing a desired quantity of fibrous material to a baling station concomitantly with moving a second baler box into position to receive charges of fibrous material;

b. compressing the fibrous material in said baler box to a final bale compression in said baling station while tramping subsequent charges of fibrous material into said second baler box; and, c. dynamically monitoring the pressure utilized by said tramping mechanism and said baling station and allocating horsepower to meet the needs of each.

5. The method as described in claim 1 wherein said iteratively urging step comprises:

a. compressing a charge of fibrous material into a pre-compression chamber along a first axis, b. maintaining said compression on said charge of fibrous material while urging said fibrous material along an orthogonal axis from said pre-compression chamber into said tramping mechanism.

6. The method as defined in claim 5 further comprising intentionally shearing any excess fibrous material extending beyond said pre-compression chamber.

7. The method as described in claim 5 further comprising varying the rate of feed of said fibrous material forming selective charges of fibrous material in accordance with said dynamically determined moisture content to achieve substantially the same weight in successive bales of fibrous material formed from said charges.

* * * * *